US008190047B2

(12) United States Patent
Isohara et al.

(10) Patent No.: US 8,190,047 B2
(45) Date of Patent: May 29, 2012

(54) IMAGE FORMING APPARATUS

(75) Inventors: Hideo Isohara, Fuchu (JP); Toru Hiramatsu, Toyokawa (JP); Akio Kasuga, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 184 days.

(21) Appl. No.: 12/824,943

(22) Filed: Jun. 28, 2010

(65) Prior Publication Data

US 2010/0329718 A1 Dec. 30, 2010

(30) Foreign Application Priority Data

Jun. 29, 2009 (JP) ..... 2009-153779

(51) Int. Cl.
*G03G 15/20* (2006.01)
*G03G 15/00* (2006.01)

(52) U.S. Cl. ..... 399/68; 399/322; 399/406

(58) Field of Classification Search ..... 399/68, 399/322, 400, 401, 406
See application file for complete search history.

(56) References Cited

U.S. PATENT DOCUMENTS 4,693,587 A * 9/1987 Shigenobu et al. ..... 399/339
7,398,027 B2 * 7/2008 Koshida et al. ..... 399/68

FOREIGN PATENT DOCUMENTS

JP 2001-48399 2/2001
JP 2004-35177 2/2004

OTHER PUBLICATIONS

Japanese Notification of Reasons for Refusal dated Apr. 12, 2011, directed to Application No. JP-2009-153779; 5 pages.

* cited by examiner

*Primary Examiner* — Hoang Ngo
(74) *Attorney, Agent, or Firm* — Morrison & Foerster LLP

(57) ABSTRACT

An image forming apparatus comprises a fixing part for fixing a toner image on a transfer material to the transfer material, a conveying part provided on the downstream side of the fixing part, a correcting member provided in a conveyance path leading from the fixing part to the conveying part, for correcting a curl of the transfer material, and a control part for controlling an upstream-side conveyance speed which is a conveyance speed at which the fixing part provided on the upstream side of the correcting member conveys the transfer material and a downstream-side conveyance speed which is a conveyance speed at which the conveying part provided on the downstream side of the correcting member conveys the transfer material. In printing of a first surface in a double-sided printing mode, the control part sets the downstream-side conveyance speed to be larger than the upstream-side conveyance speed. In printing of a second surface in the double-sided printing mode, the control part sets the upstream-side conveyance speed and the downstream-side conveyance speed so that a difference between the upstream-side conveyance speed and the downstream-side conveyance speed is smaller than a difference between the upstream-side conveyance speed and the downstream-side conveyance speed in printing of the first surface.

18 Claims, 11 Drawing Sheets

| | PRINTING OF FIRST SURFACE | PRINTING OF SECOND SURFACE |
|---|---|---|
| FIXING ROLLER PAIR | VT1 | VT2 |
| PAPER OUTPUT ROLLER PAIR | VH1 (=1. 10×VT1) | VH2 (=1. 05×VT2) |

| | PLAIN PAPER | RECYCLED PAPER |
|---|---|---|
| PRINTING OF FIRST SURFACE | 10% | 12% |
| PRINTING OF SECOND SURFACE | 3% | 8% |

IMAGE FORMING APPARATUS

This application is based on Japanese Patent Application No. 2009-153779 filed on Jun. 29, 2009, the contents of which are hereby incorporated by reference.

BACKGROUND OF THE INVENTION

1. Field of the Invention

The present invention relates to an image forming apparatus (laser beam printer or the like), and more particularly to a technique for correcting a curl of a transfer material (paper or the like).

2. Description of the Background Art

In an image forming apparatus (a laser beam printer or the like), a sheet of paper passes through a fixing part and a toner image transferred to the sheet of paper is thereby fixed onto the sheet of paper. At that time, the sheet of paper is heated and pressed by the fixing part and a curl thereby appears in the sheet of paper.

In order to avoid such a problem, there is a technique for correcting the curl appearing in the sheet of paper by pressing the sheet of paper against a guide member. In an image forming apparatus disclosed in Japanese Patent Application Laid Open Gazette No. 2001-48399 (Patent Document 1), for example, a first conveyance roller is provided on the downstream side of the fixing part and a second conveyance roller is provided on the further downstream side thereof. In a conveyance path leading from the first conveyance roller to the second conveyance roller, provided is a guide member which is curved in a direction opposite to a direction of a curl of a sheet of paper. The conveyance speed at which the second conveyance roller conveys the sheet of paper is set to a value larger than that of the conveyance speed at which at which the first conveyance roller conveys the sheet of paper. The sheet of paper is conveyed while being pressed against the guide member which is curved in a direction opposite to a direction of the curl of the sheet of paper.

Some of the image forming apparatuses comprise, as a printing mode, not only a single-sided printing mode where a single side of a sheet of paper is printed but also a double-sided printing mode where both sides (first and second sides) of a sheet of paper are printed.

In the single-sided printing mode, the curl of the sheet of paper can be corrected with the application of the above correcting technique.

In the double-sided printing mode, however, the curl of the sheet of paper cannot be appropriately corrected simply with the application of the above correcting technique. Specifically, both in printing of a first surface and in printing of a second surface, if the sheet of paper is pressed against the guide member with the same pressing force as that in a single-sided printing, the curl of the sheet of paper cannot be appropriately corrected. This phenomenon results from the fact that the curvature of a curl appearing in the sheet of paper in the printing of the second surface is different from that of a curl appearing in the sheet of paper in the printing of the first surface, as discussed later.

SUMMARY OF THE INVENTION

It is an object of the present invention to provide an image forming apparatus capable of appropriately correcting a curl appearing in a sheet of paper in a double-sided printing mode, and a technique relevant thereto.

The present invention is intended for an image forming apparatus. According to a first aspect of the present invention, the image forming apparatus comprises a fixing part for fixing a toner image on a transfer material to the transfer material, a conveying part provided on a downstream side of the fixing part, a correcting member provided in a conveyance path leading from the fixing part to the conveying part, for correcting a curl of the transfer material, and a control part for controlling an upstream-side conveyance speed which is a conveyance speed at which the fixing part provided on an upstream side of the correcting member conveys the transfer material and a downstream-side conveyance speed which is a conveyance speed at which the conveying part provided on a downstream side of the correcting member conveys the transfer material, and in the image forming apparatus of the present invention, in printing of a first surface in a double-sided printing mode, the control part sets the downstream-side conveyance speed to be larger than the upstream-side conveyance speed, and in printing of a second surface in the double-sided printing mode, the control part sets the upstream-side conveyance speed and the downstream-side conveyance speed so that a difference between the upstream-side conveyance speed and the downstream-side conveyance speed is smaller than a difference between the upstream-side conveyance speed and the downstream-side conveyance speed in printing of the first surface.

According to a second aspect of the present invention, the image forming apparatus comprises a fixing part for fixing toner of a transfer material, a first conveying part provided on a downstream side of the fixing part, a second conveying part provided on a downstream side of the first conveying part, a correcting member provided in a conveyance path leading from the first conveying part to the second conveying part, for correcting a curl of the transfer material, and a control part for controlling an upstream-side conveyance speed which is a conveyance speed at which the first conveying part provided on an upstream side of the correcting member conveys the transfer material and a downstream-side conveyance speed which is a conveyance speed at which the second conveying part provided on a downstream side of the correcting member conveys the transfer material, and in the image forming apparatus of the present invention, in printing of a first surface in a double-sided printing mode, the control part sets the downstream-side conveyance speed to be larger than the upstream-side conveyance speed, and in printing of a second surface in the double-sided printing mode, the control part sets the upstream-side conveyance speed and the downstream-side conveyance speed so that a difference between the upstream-side conveyance speed and the downstream-side conveyance speed is smaller than a difference between the upstream-side conveyance speed and the downstream-side conveyance speed in printing of the first surface.

The present invention is also intended for an image forming method. According to a third aspect of the present invention, the image forming method comprises the steps of a) fixing a toner image on a transfer material to the transfer material by using a fixing part, b) correcting a curl of the transfer material by using a correcting member provided in a conveyance path leading from the fixing part to a conveying part provided on a downstream side of the fixing part, and c) controlling an upstream-side conveyance speed which is a conveyance speed at which the fixing part provided on an upstream side of the correcting member conveys the transfer material and a downstream-side conveyance speed which is a conveyance speed at which the conveying part provided on a downstream side of the correcting member conveys the transfer material, and in the image forming method of the present invention, the step c) has the steps of c-1) setting the downstream-side conveyance speed to be larger than the upstream-side conveyance speed in printing of a first surface in a double-sided printing mode, and c-2) setting the upstream-side conveyance speed and the downstream-side conveyance speed in printing of a second surface in the double-sided printing mode so that a difference between the upstream-side conveyance speed and the downstream-side conveyance speed is smaller than a difference between the upstream-side conveyance speed and the downstream-side conveyance speed in printing of the first surface.

These and other objects, features, aspects and advantages of the present invention will become more apparent from the following detailed description of the present invention when taken in conjunction with the accompanying drawings.

DESCRIPTION OF THE PREFERRED EMBODIMENTS

Now, the preferred embodiment of the present invention will be discussed with reference to figures.

<1. Overview of Apparatus>

Figure 1:
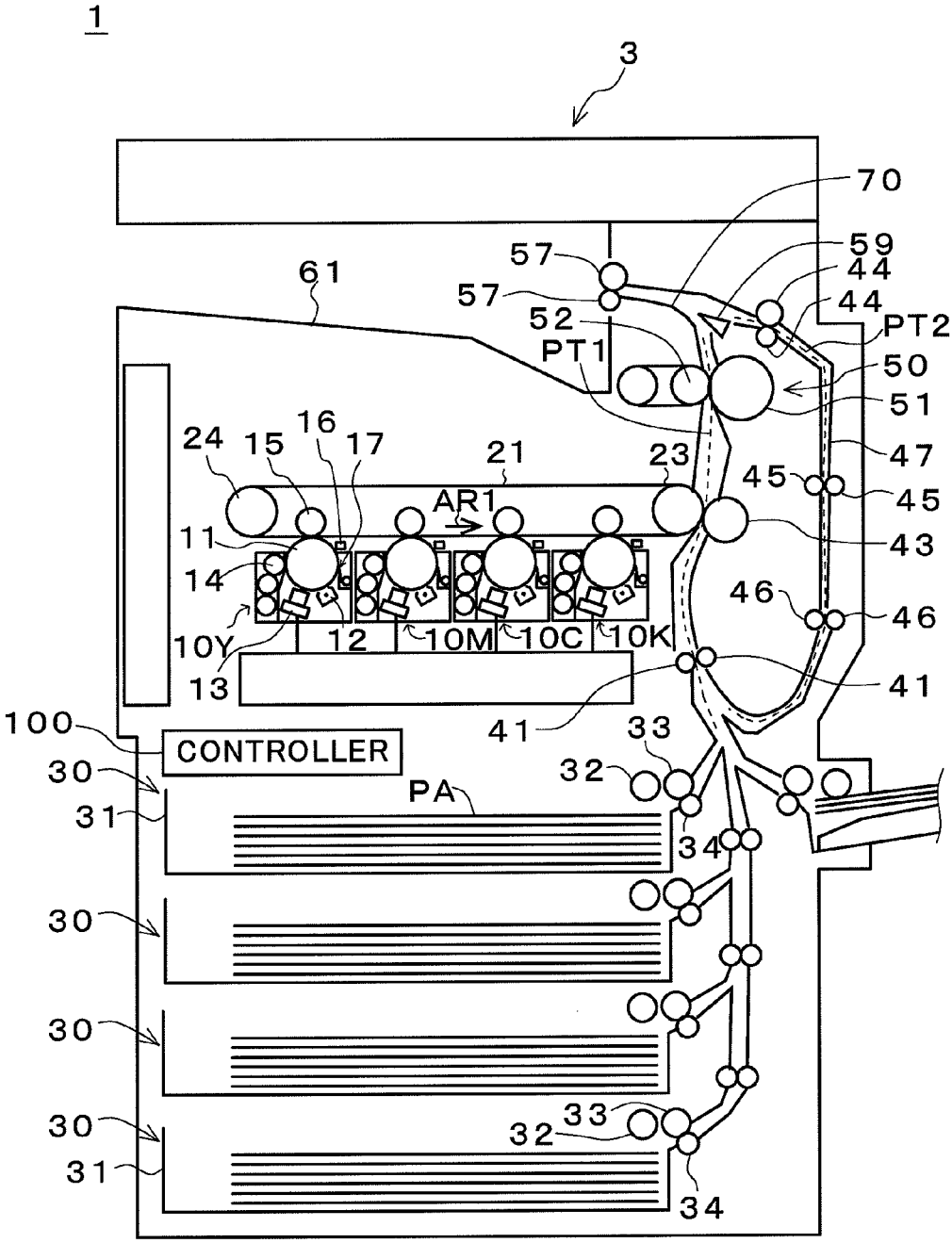
FIG. 1 is a view showing a general configuration of an image forming apparatus.

FIG. 1 is a view showing a general configuration of an image forming apparatus 1 in accordance with the preferred embodiment. The image forming apparatus 1 is an apparatus which forms an image by developing an electrostatic latent image on an image support. Herein, as an example of the image forming apparatus, shown is an electrophotographic printer, and in more detail, a tandem-type full color printer.

The image forming apparatus 1 serves as a color page printer by printing out an image with a printing mechanism described later. The image is based on image data transmitted from an information processing apparatus (personal computer or the like) connected to the image forming apparatus 1 via a network or the like. The image forming apparatus 1 also serves as a copier by printing out image data on an original document with the printing mechanism. The image data on an original document is read by a scanner 3 (optical reader) provided at an upper portion of the image forming apparatus 1.

As shown in FIG. 1, the image forming apparatus 1 comprises a plurality of (specifically, four) imaging units 10 (in detail, 10Y, 10M, 10C, and 10K). Specifically, the image forming apparatus 1 comprises a yellow imaging unit 10Y, a magenta imaging unit 10M, a cyan imaging unit 10C, and a black imaging unit 10K. Each of the imaging units 10 forms an image of the corresponding color component (specifically, any one of the color components Y (yellow), M (magenta), C (cyan), and K (black)) out of a final output image by electrophotographic method and transfers the image onto an intermediate transfer belt (also referred to as an intermediate transfer member) 21. Then, the image of the color components superimposed on the intermediate transfer belt 21 is further transferred onto a sheet of paper (also referred to as a transfer material) PA passing through a conveyance path PT1 (described later), to thereby form a full color image on the sheet of paper PA. The intermediate transfer belt 21 also serves as an image support for temporarily supporting a toner image transferred from each photosensitive material 11 (described later).

The four imaging units 10 (10Y, 10M, 10C, and 10K) are provided mainly below a lower straight portion of the intermediate transfer belt 21 which is wound around a driving roller 23 and a winding roller 24, being arranged in series along the lower straight portion of the intermediate transfer belt 21. Each of the imaging units 10 has the photosensitive material 11, a charger 12, an exposure unit 13, a developing unit 14, a first transfer unit (primary transfer unit) 15, an eraser (static eliminator) 16, and a cleaner 17. In more detail, in each imaging unit 10, the charger 12, the exposure unit 13, the developing unit 14, the first transfer unit 15, the eraser 16, and the cleaner 17 are arranged in a clockwise direction in this order around the outer perimeter of the substantially cylindrical photosensitive material 11. Among these elements, the first transfer unit (in more detail, a transfer roller (primary transfer roller)) 15 is arranged to be opposed to the photosensitive material 11 with the intermediate transfer belt 21 interposed therebetween.

Being driven by the driving roller 23, the intermediate transfer belt 21 is moved in the direction of the arrow AR1. Opposite to the driving roller 23, provided is a second transfer unit (transfer roller (secondary transfer roller)) 43 with the intermediate transfer belt 21 interposed therebetween. In accordance with voltage application by the transfer roller 43, the toner image (full color toner image or the like) on the intermediate transfer belt 21 is transferred onto the sheet of paper PA.

Further, a fixing part (fixing unit) 50 is provided in the downstream of the direction of the transfer of the sheet of paper PA having passed through the positions of the driving roller 23 and the transfer roller 43. The fixing part 50 gives heat to the sheet of paper PA to fix the toner image formed on the sheet of paper PA to the sheet of paper PA.

On the downstream side of the fixing part 50 in a conveyance direction, provided are paper output rollers 57. In a conveyance path leading from the fixing part 50 to the paper output rollers 57, further provided is a guide member 70 as a correcting member for correcting a curl of the sheet of paper PA. On the downstream side of the paper output rollers 57 in the conveyance direction, provided is a paper output tray 61.

On the lower side of the imaging units 10 and the transfer roller 43 (in the upstream of the conveyance path), provided are a plurality of paper feed parts 30. Each of the paper feed parts 30 comprises a paper feed tray 31, a pickup roller 32, a paper feed roller 33, and a flip-through roller 34 and is capable of feeding paper PA toward a timing roller 41 and the transfer roller 43.

The image forming apparatus 1 further comprises the conveyance path PT1 leading toward a paper output roller pair (57, 57) through roller pairs (41, 41), (23, 43), and (51, 52), as shown in FIG. 1. The conveyance path PT1 is formed of the roller pairs (41, 41), (23, 43), and (51, 52) and a guide member provided between the respective roller pairs, and the like.

In the single-sided printing mode, the sheet of paper PA is conveyed to the paper output tray 61 through the conveyance path PT1. Specifically, the toner image on the intermediate transfer belt 21 is transferred on one-side surface (left-side surface in FIG. 1) of the sheet of paper PA by the transfer roller 43 and the sheet of paper PA is moved to the vicinity of the fixing part 50. Then, the sheet of paper PA is subjected to a fixing process by the fixing part 50. After that, the sheet of paper PA is moved along the guide member 70 to the vicinity of the paper output roller pair (57, 57) and then outputted to the paper output tray 61 provided in the further downstream.

The image forming apparatus 1 further comprises an inverting conveyance path PT2. The inverting conveyance path PT2 is formed of roller pairs (44, 44), (45, 45), and (46, 46) and a guide member 47 provided between the respective roller pairs, and the like. The inverting conveyance path PT2 is a path for inverting the orientation of the sheet of paper PA while conveying the sheet of paper PA and serves as an alternative path for connecting the sheet of paper to the ordinary conveyance path PT1 again. By using also the inverting conveyance path PT2, the image forming apparatus 1 can perform a double-sided printing operation.

First, an operation in printing of a first surface in a double-sided printing mode will be specifically discussed. After the toner image on the intermediate transfer belt 21 is transferred on a first surface (left-side surface in FIG. 1) of the sheet of paper PA by the transfer roller 43, the sheet of paper PA is moved to the vicinity of the fixing part 50. Then, after being subjected to the fixing process by the fixing part 50, the sheet of paper PA is moved further to the downstream while being held by the paper output roller pair (57, 57). When a paper output sensor 54 (FIG. 2) detects the passing of the rear end of the sheet of paper PA through the vicinity of the paper output sensor 54, however, the direction of the rotation of the paper output roller pair (57, 57) is reversed while the paper output roller pair (57, 57) holds the sheet of paper PA. Then, the sheet of paper PA is moved in the reverse direction (in the right direction of FIG. 2) in accordance with the reverse driving of the paper output roller pair (57, 57). In the destination (on the right side) of the sheet of paper PA, provided is a switching mechanism 59 for switching the travelling direction of the sheet of paper PA. By moving the switching mechanism 59 to a predetermined position, the entry of the sheet of paper PA into the conveyance path PT1 is prevented and the sheet of paper PA goes toward the inverting conveyance path PT2.

Next, an operation in printing of a second surface in the double-sided printing mode will be specifically discussed. When the sheet of paper PA passes through the conveyance path PT1 again after passing through the inverting conveyance path PT2, the second surface (for example, the back surface) of the sheet of paper PA is present on the left side in the vicinity of the driving roller 23 (and on the lower side in the vicinity of the paper output roller 57) and can come into contact with the intermediate transfer belt 21. Thus, after the sheet of paper PA has passed through the inverting conveyance path PT2, the surface which comes into contact with the intermediate transfer belt 21 is inverted and the second surface of the sheet of paper PA becomes a surface to be printed. Then, the toner image on the intermediate transfer belt 21 is transferred to the second surface of the sheet of paper PA and subjected to the fixing process by the fixing part 50. After that, the sheet of paper PA is moved to the vicinity of the paper output roller pair (57, 57) and then conveyed to the paper output tray 61 provided in the further downstream. Thus, the image forming apparatus 1 can transfer the toner images on the intermediate transfer belt 21 to the front and back surfaces of the sheet of paper PA, respectively, and in other words, can perform the double-sided printing operation.

Figure 2:
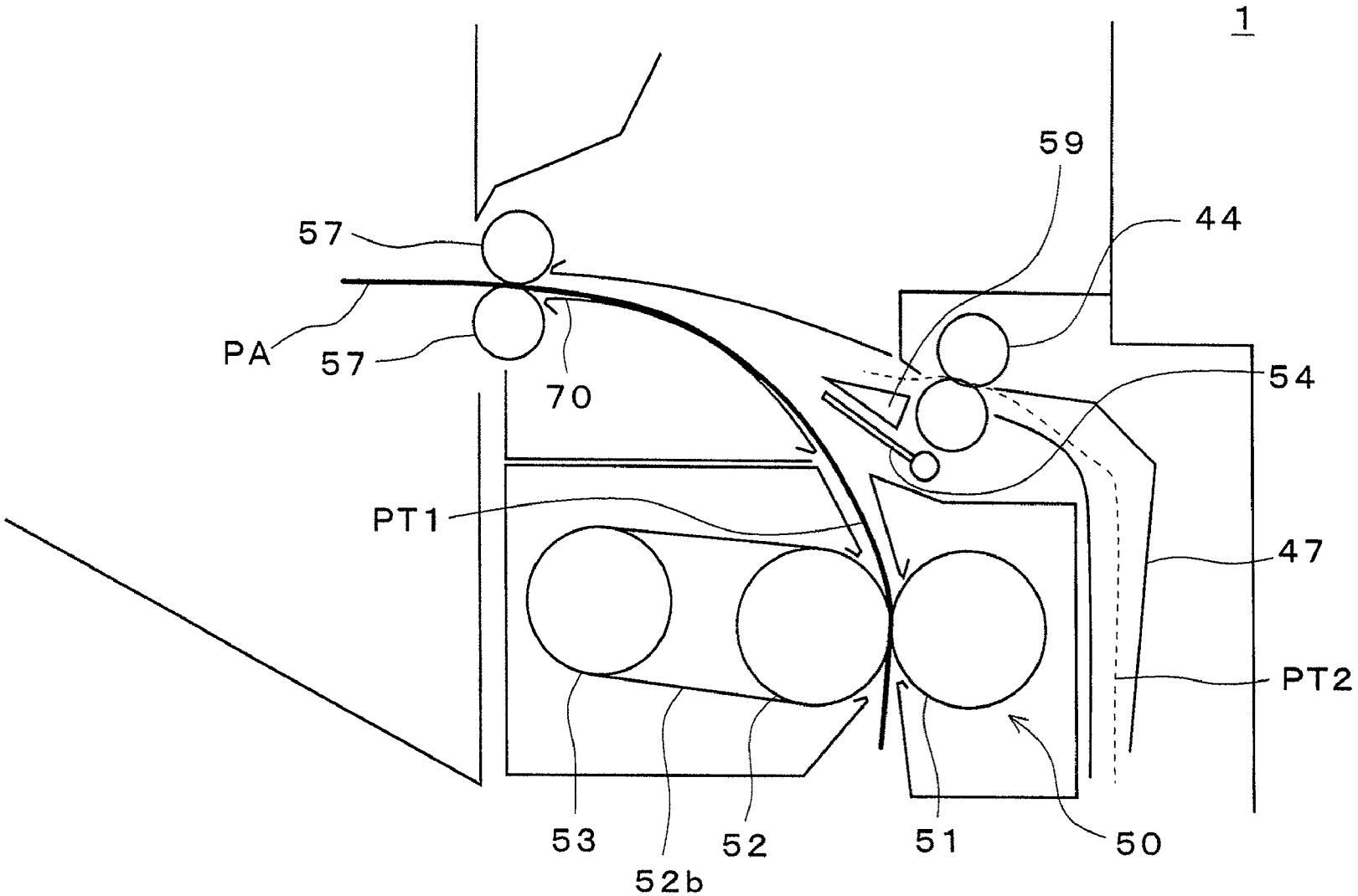
FIG. 2 is a view showing a general configuration of a fixing part and the vicinity thereof.

Now, discussion will be made on a configuration of the fixing part 50 and the vicinity thereof and the like, with reference to FIG. 2. FIG. 2 is a cross section showing a general configuration of the fixing part 50 and the vicinity thereof.

As shown in FIG. 2, the fixing part 50 comprises a pair of fixing rollers 51 and 52. The fixing roller 52 is driven by a driving roller 53 and a winding roller 52*b* to rotate.

The fixing rollers 51*a* and 52 have different surface hardnesses. In this preferred embodiment, it is assumed that the surface hardness of the fixing roller 51 is higher than that of the fixing roller 52. For example, the surface hardness of the fixing roller 51 ranges from 70 to 85 (ASKER-C hardness) and the surface hardness of the fixing roller 52 ranges from 25 to 40 (ASKER-C hardness).

The fixing rollers 51 and 52 each incorporate a heater for giving heat and the temperatures of the fixing rollers 51 and 52 are increased by the respective heaters. The temperatures of the fixing rollers 51 and 52, i.e., the temperature of the fixing part 50, are controlled by a fixing temperature control part 111 (see FIG. 3).

On the downstream side of the fixing part 50, provided are the paper output sensor 54 and the pair of paper output rollers 57. In the conveyance path leading from the fixing part 50 to the paper output rollers 57, further provided is the guide member 70 which is curved. In other words, the fixing roller pair (51, 52) is provided on the upstream side of the guide member 70 and the paper output roller pair (57, 57) is provided on the downstream side of guide member 70. Being a member for correcting a curl of the sheet of paper PA, the guide member 70 is also referred to as a correcting member.

Figure 3:
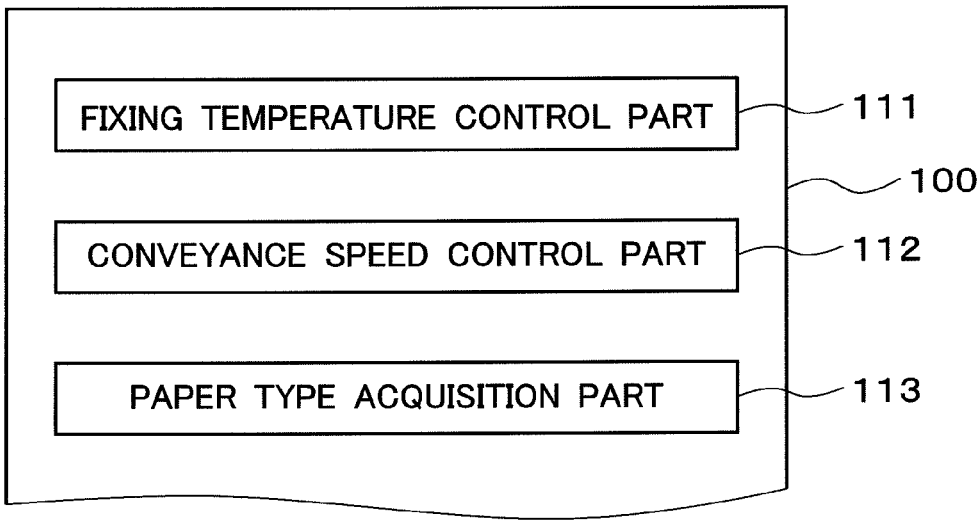
FIG. 3 is a view showing functional blocks in a controller (control part)

FIG. 3 is a view showing functional blocks in a control part (controller) 100 of the image forming apparatus 1. As shown in FIG. 3, the control part 100 comprises various functioning parts, i.e., the fixing temperature control part 111, a conveyance speed control part 112, a paper type acquisition part 113 and the like. The control part 100 is physically configured of a CPU, a semiconductor memory and the like.

The fixing temperature control part 111 controls the amount of electricity to be supplied to the heaters incorporated in the fixing rollers 51 and 52, and the like, to thereby control the temperatures of the fixing rollers 51 and 52 (in other words, the temperature of the fixing part 50).

The conveyance speed control part 112 controls the conveyance speed at which the sheet of paper PA is conveyed, by controlling the conveyance speed of each of the roller pairs provided in the image forming apparatus 1 (the outer circumferential speed of each roller pair). Specifically, the conveyance speed control part 112 controls the conveyance speed (referred to also as an upstream-side conveyance speed) at which the fixing roller pair (51, 52) provided on the upstream side of the guide member 70 conveys the sheet of paper PA and the conveyance speed (referred to also as a downstream-side conveyance speed) at which the paper output roller pair (57, 57) provided on the downstream side of the guide member 70 conveys the sheet of paper PA.

The paper type acquisition part 113 acquires information on the type of paper PA (referred to as "information on the type of transfer material") on the basis of paper type data transmitted from the information processing apparatus (personal computer or the like).

<2. Occurrence of Curl>

Next, discussion will be made on a curl of the sheet of paper PA, which appears after the sheet of paper PA passes through the fixing part 50.

Figure 4:
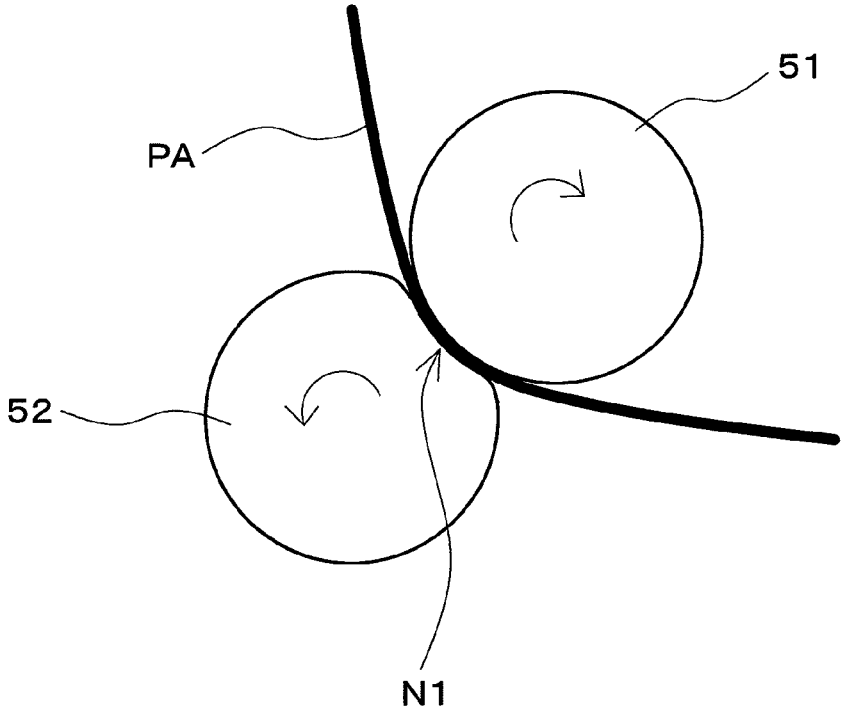
FIG. 4 is a view showing a general configuration of a fixing roller pair.
Figure 5:
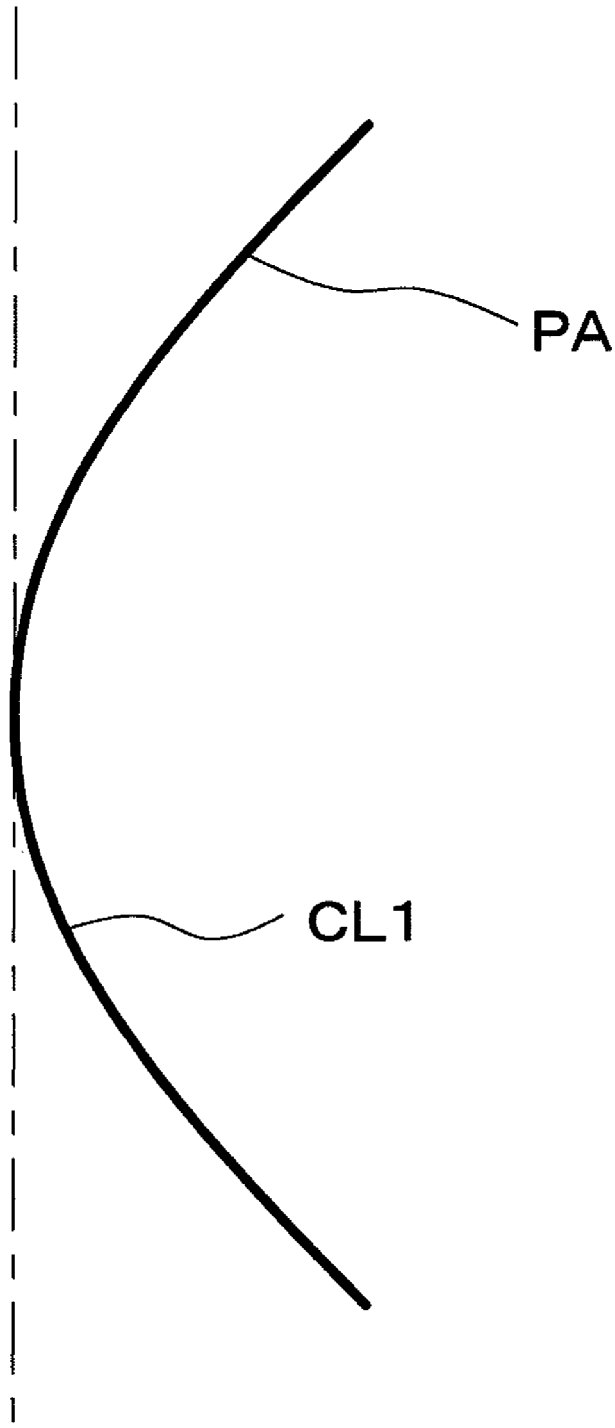
FIG. 5 is a view showing a sheet of paper after passing through the fixing part in printing of a first surface.

FIG. 4 is a view showing a manner where the sheet of paper PA passes through the fixing part 50. In this preferred embodiment, it is assumed that the surface hardness of the fixing roller 51 is higher than that of the fixing roller 52. In this case, as shown in FIG. 4, the fixing roller 51 bites into the surface of the fixing roller 52, and the fixing roller 52 is thereby transformed into a concave shape. Being transformed into a shape along the outer peripheral surface of the fixing roller 51, the sheet of paper PA passes between the fixing rollers 51 and 52 while receiving a pressure from the other fixing roller 52. Therefore, a curl along the circumferential surface of the fixing roller 51 appears in the sheet of paper PA. FIG. 5 is a view showing a curl appearing in the sheet of paper PA in such a state.

Also in the double-sided printing, such a curl as described above appears. The curvature of the curl appearing in the sheet of paper PA in the printing of the first surface, however, is different from that in the printing of the second surface. Such a situation will be discussed below.

First, in the printing of the first surface in the double-sided printing mode, the same curl as shown in FIG. 5 appears in the sheet of paper PA. Specifically, the sheet of paper PA having passed through the fixing part 50 in the printing of the first surface is transformed into a shape represented by a curve CL1 of FIG. 5. The curl is once appropriately corrected by a correcting operation using the guide member 70 immediately after the printing of the first surface (and before the printing of the second surface) as discussed later.

Figure 6:
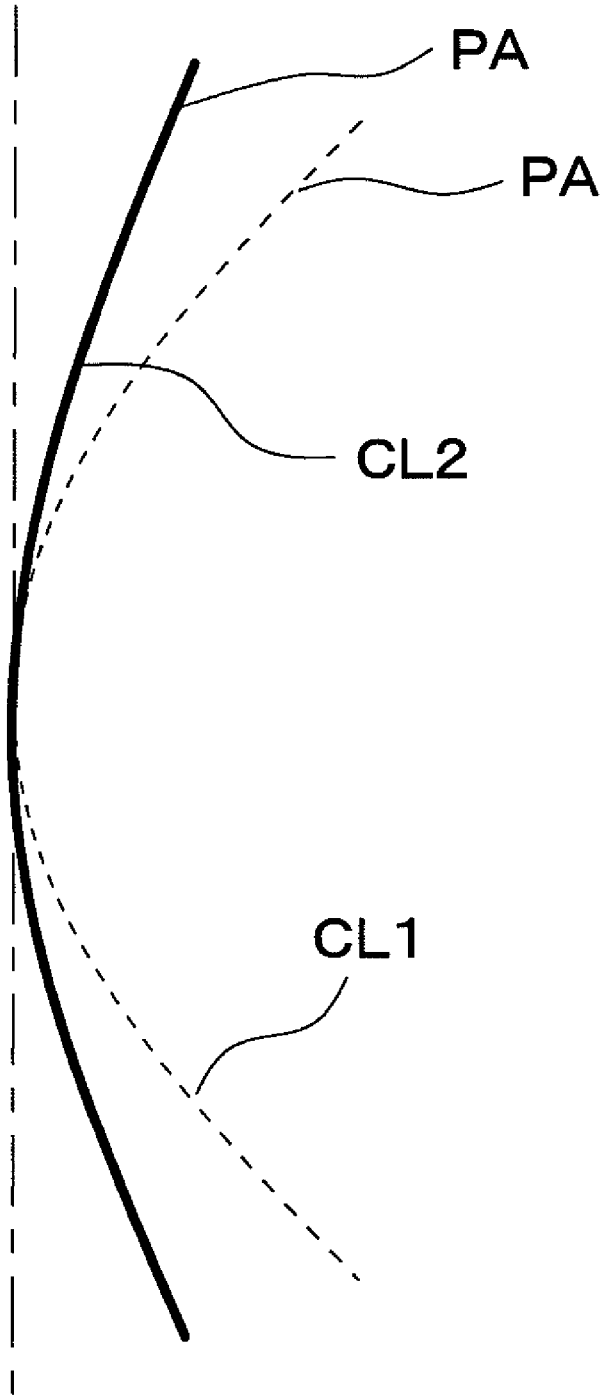
FIG. 6 is a view showing the sheet of paper after passing through the fixing part in printing of a second surface.

On the other hand, in the printing of the second surface in the double-sided printing mode, the same curl as shown in FIG. 6 appears in the sheet of paper PA. FIG. 6 is a view showing a curl appearing in the sheet of paper PA in the printing of the second surface. The sheet of paper PA having passed through the fixing part 50 in the printing of the second surface is transformed into a shape represented by a curve CL2 of FIG. 6. The curve CL2 of FIG. 6 is, however, based on the premise that the curl of the sheet of paper is once appropriately corrected by the guide member 70 immediately after the printing of the first surface (and before the printing of the second surface). In FIG. 6, for comparison, the shape of the sheet of paper PA immediately after passing through the fixing part 50 in the printing of the first surface is represented by a curve (broken line) CL1.

As can be seen from the comparison between the curve CL2 and the curve CL1 in FIG. 6, the curvature of the curl appearing in the sheet of paper PA in the printing of the second surface is smaller than that of the curl appearing in the sheet of paper PA in the printing of the first surface. In other words, the curl appearing in the printing of the second surface is gentler than the curl appearing in the printing of the first surface.

Such a phenomenon results mainly from the difference in the moisture content in the sheet of paper. In other words, the degree of curl appearing in the sheet of paper depends on the degree of moisture content in the sheet of paper.

Specifically, in the fixing process of the first surface, the moisture content in the sheet of paper PA is reduced by a relatively large amount by heating with the fixing part 50. On the other hand, at the point of time of the printing of the second surface (especially, at the point of time immediately before the fixing process of the second surface), the moisture content in the sheet of paper PA already becomes lower than that at the point of time of the printing of the first surface (especially, at the point of time immediately before the fixing process of the first surface). For this reason, in the fixing process of the second surface, the amount of moisture content in the sheet of paper PA to be reduced by heating with the fixing part 50 is relatively small. Since the deformation of the sheet of paper PA becomes smaller as the amount of moisture content to be reduced is smaller, the curvature of the curl appearing in the sheet of paper PA in the printing of the second surface is smaller than that of the curl appearing in the sheet of paper PA in the printing of the first surface.

<3. Correction of Curl>

As discussed above, the curvature of the curl appearing in the sheet of paper PA in the printing of the second surface has a value smaller than that of the curvature of the curl appearing in the sheet of paper PA in the printing of the first surface. In such a case, it is preferable that a curl appearing in the sheet of paper PA should be corrected in accordance with the curvature of the curl appearing in the sheet of paper PA.

In the image forming apparatus of this preferred embodiment, the conveyance speed control part 112 controls the conveyance speed (upstream-side conveyance speed) at which the fixing roller pair (51, 52) conveys the sheet of paper and the conveyance speed (downstream-side conveyance speed) at which the paper output roller pair (57, 57) conveys the sheet of paper and thereby changes a correction force for the sheet of paper, whereby the curl appearing in the sheet of paper PA in the double-sided printing mode can be appropriately corrected.

Figures 8, 9:
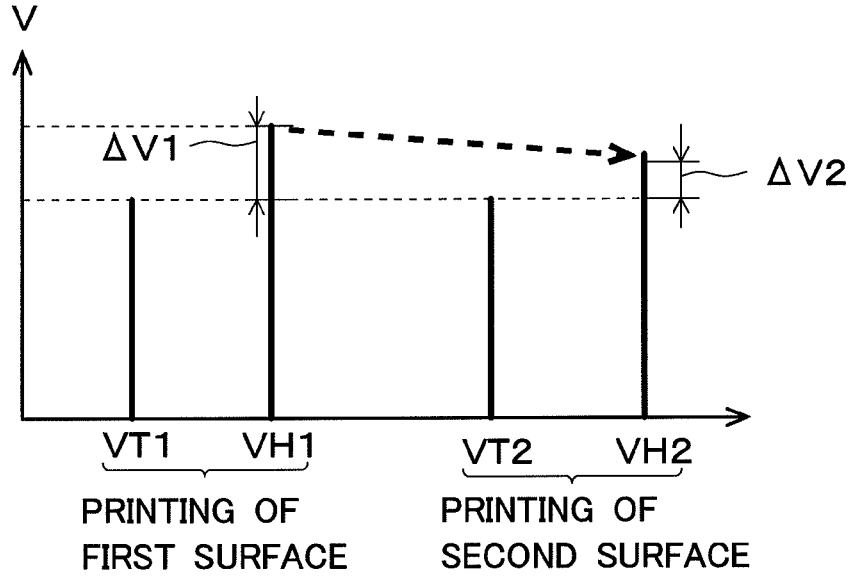
FIG. 8 is a table showing conveyance speeds.
FIG. 9 is a graph showing a relation between the conveyance speeds.

FIG. 8 shows a table showing the upstream-side conveyance speed VT1 and the downstream-side conveyance speed VH1 set in the printing of the first surface and the upstream-side conveyance speed VT2 and the downstream-side conveyance speed VH2 set in the printing of the second surface. FIG. 9 is a graph the respective values of the conveyance speeds. A conveyance speed difference ΔV1 is a difference between the value of the downstream-side conveyance speed VH1 and the value of the upstream-side conveyance speed VT1 in the printing of the first surface (ΔV1=VH1−VT1) and a conveyance speed difference ΔV2 is a difference between the value of the downstream-side conveyance speed VH2 and the value of the upstream-side conveyance speed VT2 in the printing of the second surface (ΔV2=VH2−VT2).

Discussion will be made first on a curl correcting operation in the printing of the first surface in the double-sided printing mode.

The downstream-side conveyance speed VH1 and the upstream-side conveyance speed VT1 in the printing of the first surface are set to the same values as those of the downstream-side conveyance speed VH1 and the upstream-side conveyance speed VT1 in the single-sided printing.

Specifically, as shown in FIG. 9, the downstream-side conveyance speed VH1 is set to a value larger than that of the upstream-side conveyance speed VT1. For example, the downstream-side conveyance speed VH1 is set to a value increased from the value of the upstream-side conveyance speed VT1 by 10% (VH1=1.10×VT1). In other words, a value of the speed ratio between the downstream-side conveyance speed VH and the upstream-side conveyance speed VT (VH/VT) is set to 110%.

Figure 7:
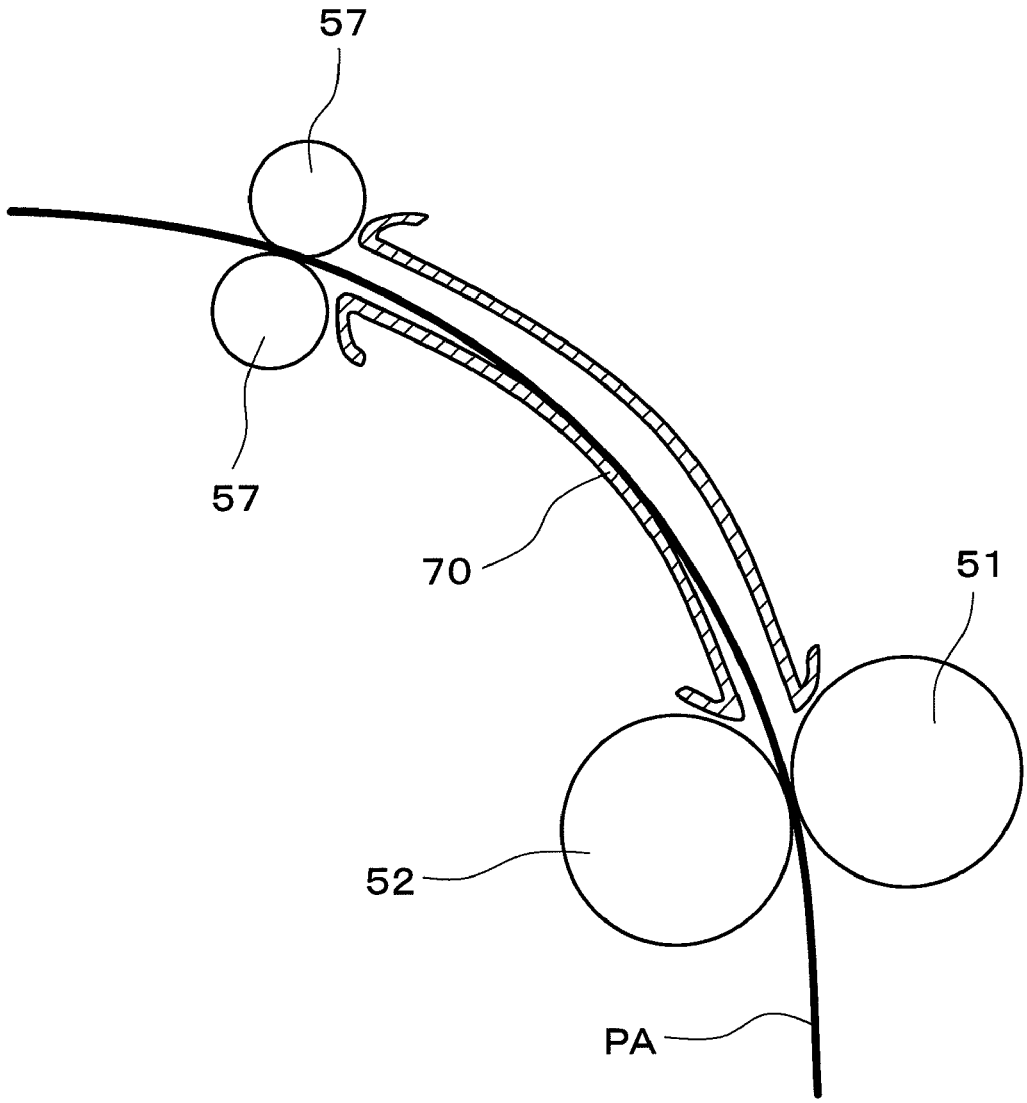
FIG. 7 is a view showing a manner where the sheet of paper is pressed against a guide member.

When such speeds VH1 and VT1 are set, as shown in FIG. 7, the sheet of paper PA is conveyed while being pressed against the guide member 70 which is curved in a direction opposite to the direction of the curl of the sheet of paper PA. As a result, a pressing force (correction force) for pressing the sheet of paper PA against the guide member 70 acts on the sheet of paper PA, whereby the curl of the sheet of paper PA having passed through the guide member 70 is appropriately corrected. Specifically, immediately after the printing of the first surface in the double-sided printing mode, like immediately after the printing in the single-sided printing mode, the curl of the sheet of paper PA is appropriately corrected.

Next, discussion will be made on a curl correcting operation in the printing of the second surface in the double-sided printing mode.

As discussed above, the curvature of the curl appearing in the printing of the second surface after the curl correction in the printing of the first surface is smaller than that of the curl having appeared before the curl correction in the printing of the first surface.

The image forming apparatus 1 of this preferred embodiment controls the pressing force for pressing the sheet of paper PA against the guide member 70 in the printing of the second surface to have a value smaller than that of the pressing force for pressing the sheet of paper PA against the guide member 70 in the printing of the first surface. The correction force for the sheet of paper PA can be thereby appropriately controlled.

Specifically, the conveyance speed control part 112 controls the upstream-side conveyance speed VT2 and the downstream-side conveyance speed VH2 in the printing of the second surface so that the conveyance speed difference ΔV1 in the printing of the second surface should be smaller than the conveyance speed difference ΔV1 in the printing of the first surface (see FIG. 9). In more detail, as shown in FIG. 9, the upstream-side conveyance speed VT1 in the printing of the first surface and the upstream-side conveyance speed VT2 in the printing of the second surface are set to the same value and the downstream-side conveyance speed VH2 in the printing of the second surface is set to have a value smaller than that of the downstream-side conveyance speed VH1 in the printing of the first surface and larger than that of the upstream-side conveyance speed VT2 in the printing of the second surface (VT2<VH2<VH1).

For example, the value of the speed ratio between the downstream-side conveyance speed VH and the upstream-side conveyance speed VT (VH/VT) is reduced from 110% (the value in the printing of the first surface) to 105% (the value in the printing of the second surface) by 5% (see FIG. 8). In other words, the rate of increase in the speed of the downstream-side conveyance speed VH to the upstream-side conveyance speed VT is reduced from 10% (the value in the printing of the first surface) to 5% (the value in the printing of the second surface) (VH2=1.05×VT2).

When the conveyance speeds VT2 and VH2 are set thus, the pressing force for pressing the sheet of paper PA against the guide member 70 in the printing of the second surface is reduced as compared with that in the printing of the first surface. Specifically, the pressing force (correction force) acting on the sheet of paper PA in the printing of the second surface becomes smaller than the pressing force (correction force) acting on the sheet of paper PA in the printing of the first surface. Therefore, in the printing of the second surface, the correction force for the curl is reduced, and it is possible to avoid excessively correcting the curl appearing in a relatively gentle manner (as compared with the curl appearing immediately after the printing of the first surface) and appropriately correct the curl in the sheet of paper.

As discussed above, in the image forming apparatus 1 of this preferred embodiment, in the printing of the second surface in the double-sided printing mode, the upstream-side conveyance speed VT2 and the downstream-side conveyance speed VH2 are set so that the difference ΔV2 between the upstream-side conveyance speed VT and the downstream-side conveyance speed VH should be smaller than the difference ΔV1 between these speeds in the printing of the first surface. In more detail, the conveyance speed VH2 of the paper output roller pair (57, 57) in the printing of the second surface is set to be smaller than the conveyance speed VH1 of the paper output roller pair (57, 57) in the printing of the first surface. It is therefore possible to appropriately correct the relatively gentle curl appearing in the printing of the second surface (which is gentler than the curl appearing in the printing of the first surface). In other words, it is possible to perform correction adapted for the curvature of the curl appearing in the sheet of paper PA in the printing of the second surface.

<4. Others>

Though the preferred embodiment of the present invention has been discussed above, the present invention is not limited to the above-discussed preferred embodiment.

For example, though the increase rate of the conveyance speed VH to the conveyance speed VT in the printing of the first surface shown in the above-discussed preferred embodiment is 10%, the increase rate is not limited to this value but may be other values (ranging from several percent to ten several percent), or the like. Similarly, the increase rate of the conveyance speed VH to the conveyance speed VT in the printing of the second surface is not limited to 5%. The upstream-side conveyance speed VT2 and the downstream-side conveyance speed VH2 in the printing of the second surface have only to be so set as to satisfy the condition that the conveyance speed difference ΔV2 should be smaller than the conveyance speed difference ΔV1, and the increase rate of the conveyance speed VH to the conveyance speed VT in the printing of the second surface may also be an appropriate value other than 5%.

Though discussion has been made in the above-discussed preferred embodiment on the case where the downstream-side conveyance speed VH2 in the printing of the second surface is set to have a value smaller than that of the downstream-side conveyance speed VH1 in the printing of the first surface and larger than that of the upstream-side conveyance speed VT2 in the printing of the second surface (see FIG. 9) (VT2<VH2<VH1), the relation of these conveyance speeds is not limited to this.

Figure 10:
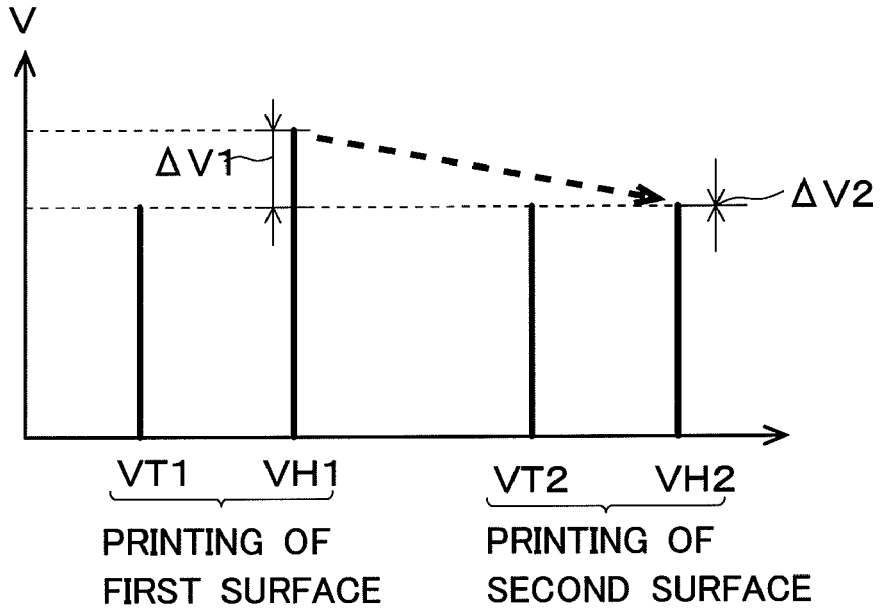
FIGS. 10 to 12 are graphs each showing a relation between the conveyance speeds in accordance with a variation.

Specifically, as shown in FIG. 10, the downstream-side conveyance speed VH2 in the printing of the second surface may be set to have a value smaller than that of the downstream-side conveyance speed VH1 in the printing of the first surface and equal to that of the upstream-side conveyance speed VT2 in the printing of the second surface (VT2=VH2<VH1). In more detail, the rate of increase in the speed of the downstream-side conveyance speed VH to the upstream-side conveyance speed VT may be reduced, for example, from 10% (the value in the printing of the first surface) to 0% (the value in the printing of the second surface) (VH2=1.00×VT2). At that time, since the speed difference ΔV2 between the upstream-side conveyance speed VT2 and the downstream-side conveyance speed VH2 in the printing of the second surface is theoretically 0 (zero) (see FIG. 10), the degree of curl correction in the printing of the second surface can be reduced to almost zero, and in other words, it is possible to almost eliminate the necessity of the curl correction. Therefore, particularly in a case where no curl appears in the sheet of paper PA in the printing of the second surface or the like, it is possible to appropriately correct the curl finally appearing in the sheet of paper in the double-sided printing mode.

Thus, the downstream-side conveyance speed VH2 in the printing of the second surface may be set to the same value as that of the downstream-side conveyance speed VH1 in the printing of the first surface. In this case, the downstream-side conveyance speed VH2 in the printing of the second surface is not necessarily required to be set to the completely same value as that of the downstream-side conveyance speed VH1 in the printing of the first surface. In more detail, the downstream-side conveyance speed VH2 in the printing of the second surface may be set to a value ranging from −3% to +3% of (i.e., almost the same value as (in other words, the substantially the same value as)) the value of the downstream-side conveyance speed VH1 in the printing of the first surface. Since this can almost eliminate the necessity of the curl correction, the same effect can be produced.

Figure 11:
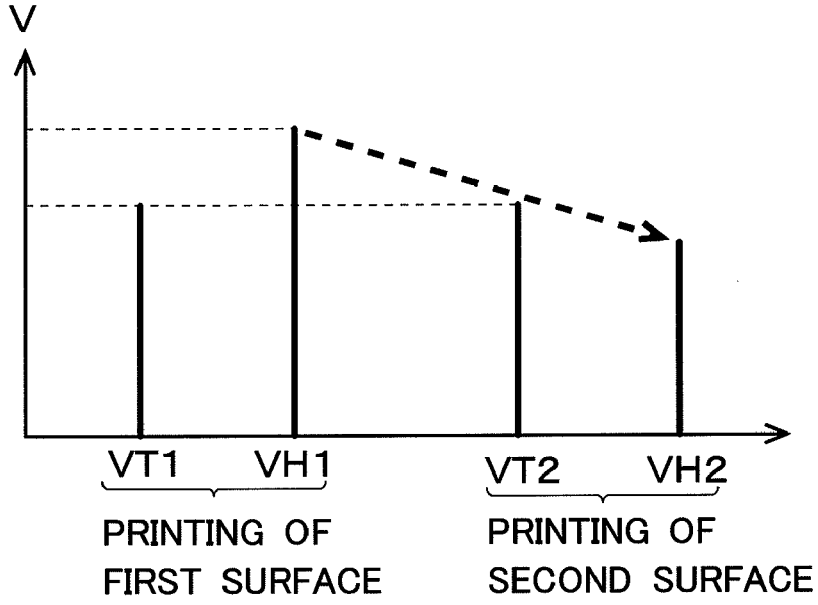

Further, as shown in FIG. 11, the downstream-side conveyance speed VH2 in the printing of the second surface may be set to have a value smaller than that of the downstream-side conveyance speed VH1 in the printing of the first surface and smaller than that of the upstream-side conveyance speed VT2 in the printing of the second surface (VH2<VH1 and VH2<VT2). For example, the rate of increase in the speed of the downstream-side conveyance speed VH to the upstream-side conveyance speed VT may be reduced from 10% (the value in the printing of the first surface) to −7% (the value in the printing of the second surface) (VH2=0.93×VT2). Also in this case, since no curl correction is performed in the printing of the second surface, the same effect can be produced.

Though discussion has been made in the above-discussed preferred embodiment on the case where the upstream-side conveyance speed VT in the printing of the first surface and the upstream-side conveyance speed VT2 in the printing of the second surface are set to the same value (VT1=VT2), the relation of these upstream-side conveyance speeds is not limited to this.

Figures 12, 13:
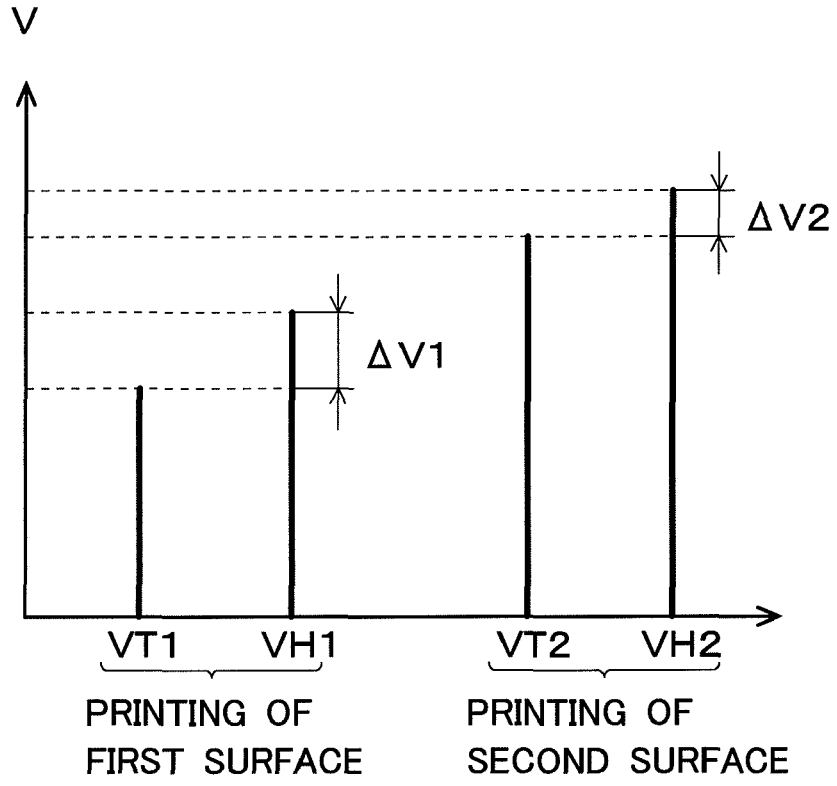
FIG. 13 is a table showing conveyance speeds in accordance with the variation.

More specifically, as shown in FIG. 12, the upstream-side conveyance speed VT2 in the printing of the second surface may be set to a value larger than that of the upstream-side conveyance speed VT1 in the printing of the first surface (VT1<VT2). In FIG. 12, the increase rate of the downstream-side conveyance speed VH2 to the upstream-side conveyance speed VT2 in the printing of the second surface is suppressed as compared with the increase rate of the downstream-side conveyance speed VH1 to the upstream-side conveyance speed VT1 in the printing of the first surface. Thus, the downstream-side conveyance speed VH2 in the printing of the second surface and the like may be so set as to satisfy the condition that the speed difference ΔV2 between the conveyance speeds VH2 and VT2 in the printing of the second surface (=VH2−VT2) should be smaller than the speed difference ΔV1 between the conveyance speeds VH1 and VT1 in the printing of the first surface (=VH1−VT1) (ΔV2<ΔV1).

Conversely, the upstream-side conveyance speed VT2 in the printing of the second surface may be set to a value smaller than that of the upstream-side conveyance speed VT1 in the printing of the first surface (VT1>VT2). Also in this case, the downstream-side conveyance speed VH2 in the printing of the second surface and the like may be so set as to satisfy the condition that the speed difference ΔV2 should be smaller than the speed difference ΔV1 (ΔV2<ΔV1).

Though discussion has been made in the above-discussed preferred embodiment on the case where the information on the paper type of the sheet of paper PA is not considered, the present invention is not limited to this case. For example, as shown in FIG. 13, the conveyance speeds (VT1, VH1, VT2, and VH2) in the case where the paper PA is plain paper and the conveyance speeds (VT1, VH1, VT2, and VH2) in the case where the paper PA is recycled paper may be set to have different values, respectively.

In FIG. 13, in the case where the paper PA is plain paper, the downstream-side conveyance speed VH1 is set to a value increased from the value of the upstream-side conveyance speed VT1 by 10% (VH1=1.10×VT1) in the printing of the first surface and the downstream-side conveyance speed VH2 is set to a value increased from the value of the upstream-side conveyance speed VT2 by 3% (VH2=1.03×VT2) in the printing of the second surface. On the other hand, in the case where the paper PA is recycled paper, the downstream-side conveyance speed VH1 is set to a value increased from the value of the upstream-side conveyance speed VT1 by 12% (VH1=1.12×VT1) in the printing of the first surface and the downstream-side conveyance speed VH2 is set to a value increased from the value of the upstream-side conveyance speed VT2 by 8% (VH2=1.08×VT2) in the printing of the second surface.

Thus, considering that a curl is easier to appear in recycled paper than in plain paper, the speed differences ΔV1 and ΔV2 for the recycled paper may be set to values larger than the speed differences ΔV1 and ΔV2 for the plain paper, respectively, to thereby cause a relatively large correction force to act on the recycled paper. It is thereby possible to appropriately correct respective curls appearing in different types of paper PA. Further, it is preferable that the degree of reduction from the speed difference ΔV2 to the speed difference ΔV1 should be changed depending on the paper type.

Figure 14:
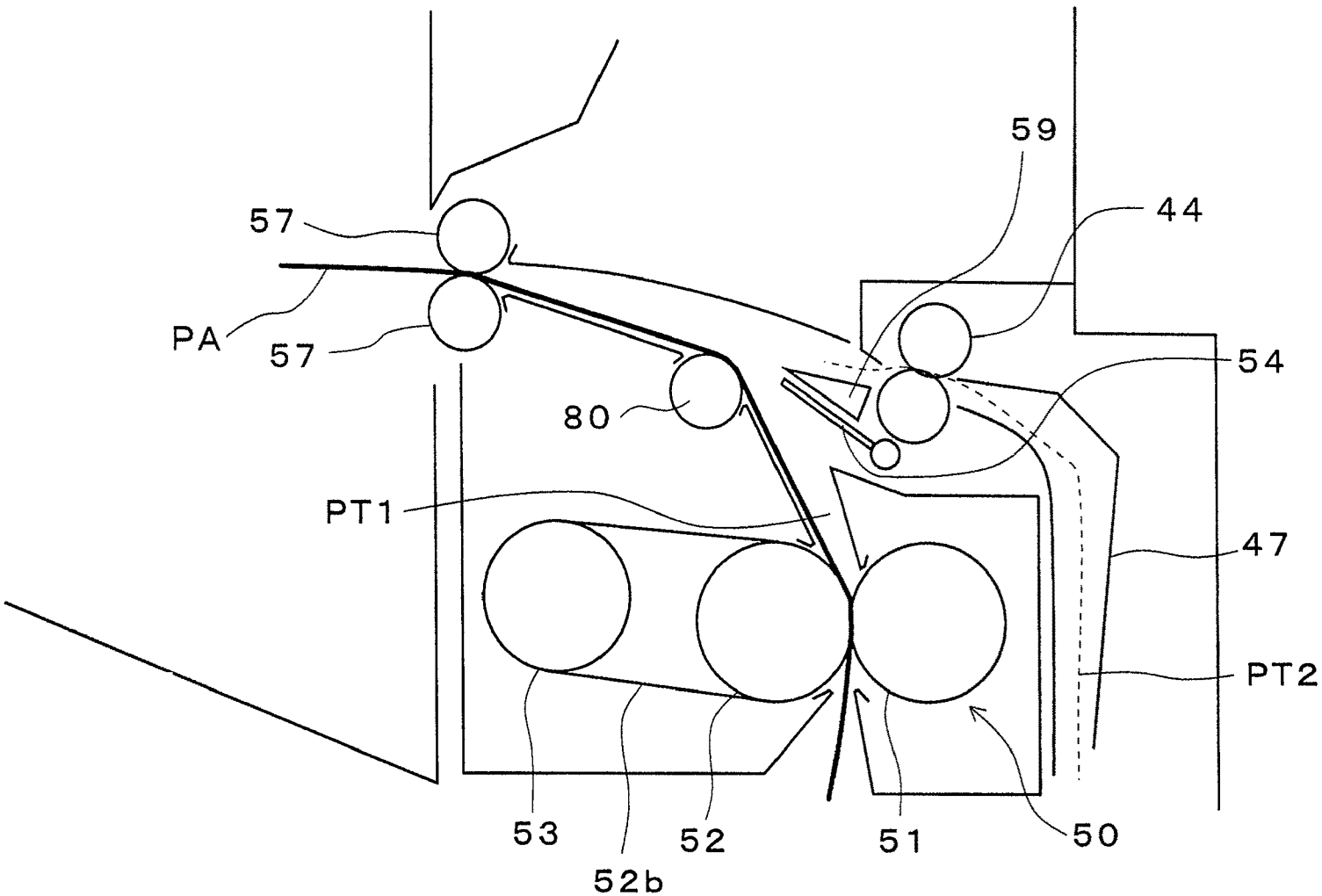
FIGS. 14 and 15 are views each showing a general configuration of the fixing part and the vicinity thereof in accordance with the variation.

Though discussion has been made in the above-discussed preferred embodiment on the case where the guide member 70 is provided in the conveyance path leading from the fixing part 50 to the paper output rollers 57, the configuration is not limited to this. For example, a driven roller may be provided as a correcting member for correcting a curl. In more detail, as shown in FIG. 14, the driven roller 80 may be provided in the conveyance path leading from the fixing part 50 to the paper output rollers 57. In the case where the sheet of paper PA is conveyed by the fixing part 50 and the paper output rollers 57, the driven roller 80 is so arranged as to curve (or bend) the sheet of paper PA in a direction opposite to the direction of the curl appearing in the sheet of paper PA. When the conveyance speed control part 112 sets the conveyance speed of the paper output roller pair (57, 57) to a value larger than that of the conveyance speed of the fixing roller pair (51, 52), the sheet of paper PA is conveyed while being pressed against the driven roller 80. Also by using the driven roller 80 thus, the curl appearing in the sheet of paper PA can be corrected. In such a configuration, the degree of curl correction can be appropriately controlled by controlling the conveyance speeds VH1, VH2, VT1, and VT2 to adjust the pressing force against the driven roller 80.

Figure 15:
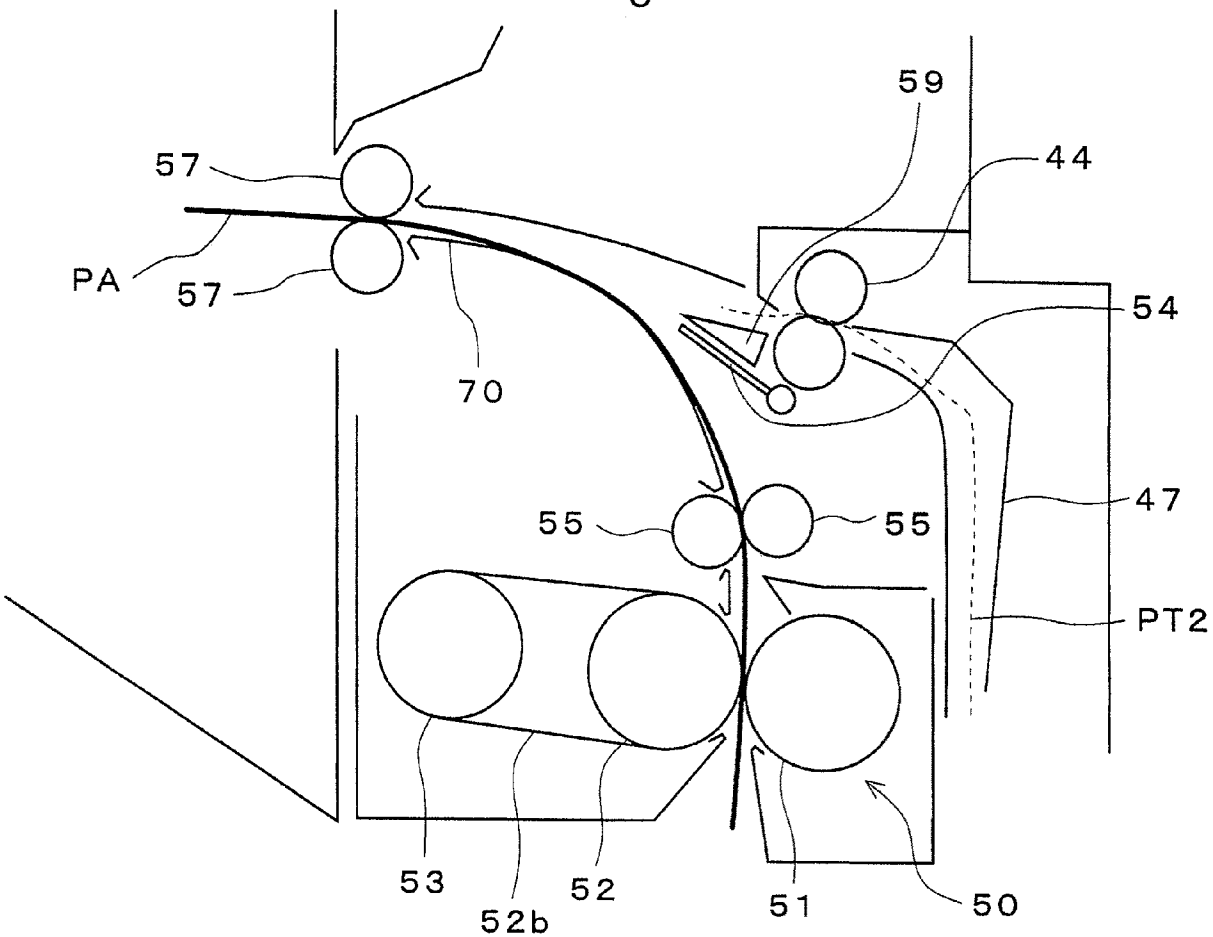

Though discussion has been made in the above-discussed preferred embodiment on the case where the pressing force against the correcting member is controlled by controlling the conveyance speed of the fixing roller pair (51, 52) and the conveyance speed of the paper output roller pair (57, 57), the present invention is limited to this. There may be a case, for example, as shown in FIG. 15, where a conveyance roller pair (55, 55) is further provided on the downstream side of the fixing part 50 and on the upstream side of the guide member 70 and the speed of the conveyance roller pair (55, 55) and the speed of the paper output roller pair (57, 57) are controlled. Specifically, the speed of the conveyance roller pair (55, 55) may be controlled in the same manner as the fixing roller pair (51, 52) are controlled in the above-discussed preferred embodiment or the like. It is also thereby possible to control the pressing force against the guide member 70 (correcting member).

Though discussion has been made in the above-discussed preferred embodiment on the case where a curl appears in the sheet of paper PA due to the difference in the surface hardness between the fixing roller 51 and the fixing roller 52, the present invention is not applied only to this case. The above principle can be applied to a case where a curl appears in the sheet of paper PA due to any other factors.

Though discussion has been made in the above-discussed preferred embodiment on a tandem-type color printer as an example of the image forming apparatus, the present invention is not limited to this case. The above-discussed principle may be applied to, for example, other types of printers (a four-cycle color printer or a monochrome printer) or the like.

While the invention has been shown and described in detail, the foregoing description is in all aspects illustrative and not restrictive. It is therefore understood that numerous modifications and variations can be devised without departing from the scope of the invention.

What is claimed is:

1. An image forming apparatus, comprising:

a fixing part for fixing a toner image on a transfer material to said transfer material;

a conveying part provided on a downstream side of said fixing part;

a correcting member provided in a conveyance path leading from said fixing part to said conveying part, for correcting a curl of said transfer material; and a control part for controlling an upstream-side conveyance speed which is a conveyance speed at which said fixing part provided on an upstream side of said correcting member conveys said transfer material and a downstream-side conveyance speed which is a conveyance speed at which said conveying part provided on a downstream side of said correcting member conveys said transfer material, wherein in printing of a first surface in a double-sided printing mode, said control part sets said downstream-side conveyance speed to be larger than said upstream-side conveyance speed, and in printing of a second surface in said double-sided printing mode, said control part sets said upstream-side conveyance speed and said downstream-side conveyance speed so that a difference between said upstream-side conveyance speed and said downstream-side conveyance speed is smaller than a difference between said upstream-side conveyance speed and said downstream-side conveyance speed in printing of said first surface.

2. The image forming apparatus according to claim 1, wherein said control part sets said downstream-side conveyance speed in printing of said second surface to be smaller than said downstream-side conveyance speed in printing of said first surface.

3. The image forming apparatus according to claim 1, wherein said control part sets said upstream-side conveyance speed and said downstream-side conveyance speed to have substantially the same value in printing of said second surface.

4. The image forming apparatus according to claim 1, wherein said correcting member has a curved guide member.

5. The image forming apparatus according to claim 4, wherein said fixing part has a first roller and a second roller which have different surface hardnesses, and said guide member is curved in a direction opposite to a direction in which said transfer material is curved due to a difference between a surface hardness of said first roller and a surface hardness of said second roller.

6. The image forming apparatus according to claim 1, wherein said correcting member has a driven roller.

7. An image forming apparatus, comprising:

a fixing part for fixing toner of a transfer material;

a first conveying part provided on a downstream side of said fixing part;

a second conveying part provided on a downstream side of said first conveying part;

a correcting member provided in a conveyance path leading from said first conveying part to said second conveying part, for correcting a curl of said transfer material; and a control part for controlling an upstream-side conveyance speed which is a conveyance speed at which said first conveying part provided on an upstream side of said correcting member conveys said transfer material and a downstream-side conveyance speed which is a conveyance speed at which said second conveying part provided on a downstream side of said correcting member conveys said transfer material, wherein in printing of a first surface in a double-sided printing mode, said control part sets said downstream-side conveyance speed to be larger than said upstream-side conveyance speed, and in printing of a second surface in the double-sided printing mode, said control part sets said upstream-side conveyance speed and said downstream-side conveyance speed so that a difference between said upstream-side conveyance speed and said downstream-side conveyance speed is smaller than a difference between said upstream-side conveyance speed and said downstream-side conveyance speed in printing of said first surface.

8. The image forming apparatus according to claim 7, wherein said control part sets said downstream-side conveyance speed in printing of said second surface to be smaller than said downstream-side conveyance speed in printing of said first surface.

9. The image forming apparatus according to claim 7, wherein said control part sets said upstream-side conveyance speed and said downstream-side conveyance speed to have substantially the same value in printing of said second surface.

10. The image forming apparatus according to claim 7, wherein said correcting member has a curved guide member.

11. The image forming apparatus according to claim 10, wherein said fixing part has a first roller and a second roller which have different surface hardnesses, and said guide member is curved in a direction opposite to a direction in which said transfer material is curved due to a difference between a surface hardness of said first roller and a surface hardness of said second roller.

12. The image forming apparatus according to claim 7, wherein said correcting member has a driven roller.

13. An image forming method, comprising the steps of:

a) fixing a toner image on a transfer material to said transfer material by using a fixing part;

b) correcting a curl of said transfer material by using a correcting member provided in a conveyance path leading from said fixing part to a conveying part provided on a downstream side of said fixing part; and c) controlling an upstream-side conveyance speed which is a conveyance speed at which said fixing part provided on an upstream side of said correcting member conveys said transfer material and a downstream-side conveyance speed which is a conveyance speed at which said conveying part provided on a downstream side of said correcting member conveys said transfer material, wherein said step c) has the steps of:

c-1) setting said downstream-side conveyance speed to be larger than said upstream-side conveyance speed in printing of a first surface in a double-sided printing mode, and c-2) setting said upstream-side conveyance speed and said downstream-side conveyance speed in printing of a second surface in the double-sided printing mode so that a difference between said upstream-side conveyance speed and said downstream-side conveyance speed is smaller than a difference between said upstream-side conveyance speed and said downstream-side conveyance speed in printing of said first surface.

14. The image forming method according to claim 13, wherein said downstream-side conveyance speed in printing of said second surface is set to have a value smaller than that of said downstream-side conveyance speed in printing of said first surface.

15. The image forming method according to claim 13, wherein said upstream-side conveyance speed and said downstream-side conveyance speed are set to have substantially the same value in printing of said second surface.

16. The image forming method according to claim 13, wherein said correcting member has a curved guide member.

17. The image forming method according to claim 16, wherein said fixing part has a first roller and a second roller which have different surface hardnesses, and said guide member is curved in a direction opposite to a direction in which said transfer material is curved due to a difference between a surface hardness of said first roller and a surface hardness of said second roller.

18. The image forming method according to claim 13, wherein said correcting member has a driven roller.

* * * * *